US006129217A

United States Patent [19]

Trickey et al.

[11] Patent Number: 6,129,217

[45] Date of Patent: Oct. 10, 2000

[54] HYDROCYCLONE AND SEPARATOR ASSEMBLIES UTILIZING HYDROCYCLONES

[75] Inventors: Lawrence A. Trickey, London, Canada; Geoffrey J. Childs, Truro, United Kingdom

[73] Assignee: Corn Products International, Inc.

[21] Appl. No.: 08/808,588

[22] Filed: Feb. 28, 1997

Related U.S. Application Data

[63] Continuation-in-part of application No. 08/627,220, Mar. 29, 1996, abandoned.

[51] Int. Cl.[7] ..... B04C 5/00

[52] U.S. Cl. ..... 209/727; 209/728; 209/732; 209/733; 209/734

[58] Field of Search ..... 209/725, 727, 209/728, 732, 733, 734, 711, 715, 717, 719, 720, 721; 210/787, 512.1

[56] References Cited

U.S. PATENT DOCUMENTS

| | | | |
|---|---|---|---|
| 2,765,918 | 10/1956 | Fontein et al. | 210/51 |
| 3,261,467 | 7/1966 | Wikdahl | 209/211 |
| 3,358,833 | 12/1967 | Cantrell . | |
| 3,371,794 | 3/1968 | Johnson | 210/512 |
| 3,494,474 | 2/1970 | Estabrook | 210/512 |
| 3,747,306 | 7/1973 | Wikdahl | 55/349 |
| 3,800,946 | 4/1974 | Reid et al. | 210/84 |
| 3,893,914 | 7/1975 | Bobo . | |
| 3,940,331 | 2/1976 | Rastatter | 209/211 |
| 3,988,239 | 10/1976 | Malina . | |
| 3,989,628 | 11/1976 | Bier | 210/255 |
| 4,123,364 | 10/1978 | Mozley | 210/512 |
| 4,148,723 | 4/1979 | Mozley | 209/211 |
| 4,189,377 | 2/1980 | Dahlberg et al. | 209/211 |
| 4,260,480 | 4/1981 | Lewis et al. | 209/211 |
| 4,426,283 | 1/1984 | Fecske | 209/211 |
| 4,539,105 | 9/1985 | Metcalf . | |
| 4,581,142 | 4/1986 | Fladby et al. | 210/512.1 |
| 4,650,584 | 3/1987 | Macierewicz | 210/512.2 |
| 4,673,495 | 6/1987 | Carroll et al. | 210/232 |
| 4,765,887 | 8/1988 | Lister . | |
| 4,793,925 | 12/1988 | Duvall et al. | 210/512.1 |
| 4,797,203 | 1/1989 | Macierewicz . | |
| 5,194,150 | 3/1993 | O'Brien et al. | 210/233 |
| 5,336,410 | 8/1994 | O'Brien et al. | 210/512.1 |
| 5,388,708 | 2/1995 | Bouchillon et al. | 209/728 |
| 5,499,720 | 3/1996 | Bouchillon et al. | 209/728 |

FOREIGN PATENT DOCUMENTS

| | | |
|---|---|---|
| 1286635 | 7/1991 | Canada . |
| 0003594 | 8/1979 | European Pat. Off. . |
| 3116873 | 11/1982 | Germany . |
| 1072524 | 6/1967 | United Kingdom . |
| 2136327 | 9/1984 | United Kingdom . |

OTHER PUBLICATIONS

Sales Brochure for Dorrclone Type TMC, TM, and C cyclones, 1976.

Sales Brochure for DorrClone Hydrocyclone, 1984.

*Primary Examiner*—David H. Bollinger

*Attorney, Agent, or Firm*—Norris, McLaughlin & Marcus

[57] ABSTRACT

Hydrocyclones for use in separator assemblies, which have stationary wall members or at least one removable wall member and contain a plurality of hydrocyclones, include a tubular body having an under flow end and an overflow end. The hydrocyclone has an interior defined by an axially-extending frusto-conical separating chamber which extends from an inlet chamber nearer the overflow end to an underflow outlet opening at the underflow end. The body also has a rectangular tangential inlet to the inlet chamber. The hydrocyclone further includes a tubular vortex-finder member which fits through the overflow end of the body into a cooperating seat therein. The vortex-finder member is seated in a predetermined position in which a portion thereof extends through the inlet chamber to define the axial overflow outlet from the separating chamber. The portion has a helical guide surface to guide the inlet flow from the tangential inlet towards the separating chamber.

36 Claims, 10 Drawing Sheets

HYDROCYCLONE AND SEPARATOR ASSEMBLIES UTILIZING HYDROCYCLONES

This application is a continuation-in-part of application Ser. No. 08/627,220 filed Mar. 29, 1996, now abandoned.

FIELD OF THE INVENTION

The present invention relates to hydrocyclones for separating a slurry into separate constituents by density and to separator assemblies utilizing hydrocyclones. More particularly, the present invention relates to the design, manufacture and assembly of hydrocyclones and separator assemblies utilizing hydrocyclones.

BACKGROUND OF THE INVENTION

It is well known to use hydrocyclones to separate particles of different sizes carried in a fluid stream. The particle separation achieved is governed by various factors including the dimensions of the hydrocyclone, the density of the suspension to be separated and its inlet pressure. To achieve some separations, it is necessary to use extremely small hydrocyclones which have a correspondingly small throughput. In order to achieve a commercially viable throughput, it is then necessary to employ a multitude of such hydrocyclones assembled in parallel. The most effective use of hydrocyclones is in separator assemblies with multi-stage operations. In the corn wet milling industry, hydrocyclones are used in starch wash operations, where multi-stage counter-current assemblies are preferred for purification of starch by removal of contaminants in the light phase, such as soluble and insoluble proteins, fine fibers, etc.

One type of a known separator assembly which uses a multitude of hydrocyclones is illustrated in FIGS. 1 to 3 of the accompanying drawings, in which:

FIG. 1 is a schematic, partially sectioned side elevational view of part of the prior art separator assembly;

FIG. 2 is a section taken on line II—II of FIG. 1; and

FIG. 3 is an enlarged axial-sectional view of a hydrocyclone incorporated in the assembly of FIGS. 1 and 2.

The prior art assembly of FIGS. 1 to 3 will now be described in brief with an emphasis on those parts which lead to an understanding of the present invention.

With reference to FIG. 1, a part of a separator assembly generally indicated 10 is shown. Separator assembly 10 has a generally cylindrical casing 12, only one end portion of which is shown, and which is constituted by annular walls 14 and end walls 16. Walls 14, 16 are clamped together by longitudinally extending bolt members 18 and end clamp members (not shown) with the interposition of pairs of transverse round partitions 20, 22 extending perpendicular to casing 12 axis and clamped between adjacent edges of annular walls 14. Only one pair of partitions 20, 22 is shown. Casing 12 may include any number of such pairs of partitions 20, 22. Partitions 20, 22 each have outer faces 24, 26 and opposing inner faces 28, 30, respectively.

With reference to FIGS. 1 and 2, each partition 20, 22 has a plurality of circular apertures 32, 34, respectively, arranged in regular two dimensional arrays. Apertures 32, 34 in each pair of partitions 20, 22 are axially aligned. Not all of apertures 32, 34 are shown in FIG. 2, for clarity of illustration.

Partitions 20, 22 define central inlet chamber 36 between their opposing faces 28, 30 and two outlet chambers 38, 40 adjacent their outer faces 24, 26, respectively. An inlet duct 42 opens into central inlet chamber 36 while outlet ducts 44, 46 open from outlet chambers 38, 40, respectively.

Inlet chamber 36 does not communicate directly through apertures 32, 34 in partitions 20, 22 with outlet chambers 38, 40 but through hydrocyclones 48, each of which extends parallel to chamber 36 axis.

With reference to FIG. 3, each hydrocyclone 48 is formed in two cooperatingly screw threaded parts 50 and 52. Part 52 has an underflow end 54 and an opposite overflow end 56. Parts 50 and 52 have substantially cylindrical outer surfaces 58 and 60, each formed with annular grooves 62 and 64 therein and having flange 66 and end flange 68, projecting from their ends. O-rings 70 are provided to fit into each of the cooperating grooves 62 and 64.

When interengaged, the inner surface of part 52 defines a frusto-conical internal separating chamber 72 to extend and taper between overflow end 56 and underflow end 54 thereof. Surface 60 has inlet cavity 74 formed at overflow end 56 of part 52. Each inlet cavity 74 has a circular tangential inlet opening 76 into it from central chamber 36.

Continuing with FIG. 3, vortex finder 78 projects through inlet cavity 74, terminating axially downstream of tangential inlet opening 76 and defines a first axial outlet 80, the overflow outlet, which communicates with the adjacent outlet chamber 38 (shown in FIG. 1) of assembly 10 while the opposite underflow end 54 of hydrocyclone 48, clamped in the opposite partition 22, has a second axial outlet 82, the underflow outlet, which communicates with outlet chamber 40. Vortex finder 78 also defines a helical channel 84 (not shown) the beginning of which faces inlet opening 76.

When assembled in assembly 10, hydrocyclones 48 extend through and are sealed in apertures 32 and 34 by means of O-rings 70 fitted in grooves 62 and 64, which create seals between central chamber 36 and outlet chambers 38 and 40, respectively. Inlet cavity 74 is located adjacent partition 20. Flange 66 of part 50 abuts outer face 24 of partition 20, while end flange 68 of part 52 abuts outer face 26 of part 22.

In use of assembly 10, a suspension to be classified is pumped under pressure into central inlet chamber 36 through inlet duct 42 and is forced through tangential inlet openings 76 of hydrocyclones 48 into their frusto-conical chambers 72. Helical channel 84, defined by vortex finder 78, ducts the inlet flow circumferentially and axially toward frusto-conical chamber 72, thereby reducing the turbulence that would arise in a purely cylindrical inlet cavity. In each chamber 72, the suspension is separated into two flows. The first, termed the overflow, contains the finer particles and exits through first axial outlet 80 into chamber 38 while the second, termed the underflow, containing coarser particles, exits through the opposite outlet 82 into chamber 40. Naturally, the combined overflows from hydrocyclones 48 exit from assembly 10 through outlet duct 44 while the combined underflows exit through outlet duct 46.

Separator assembly 10 described in relation to FIGS. 1 to 3 achieves good separation, but has certain problems and disadvantages.

A first problem is in the assembly of hydrocyclones 48. In order to enable hydrocyclones 48 to be inserted and firmly held in their positions of use, extending through partitions 20 and 22, parts 50 and 52 are inserted through opposing apertures 32 and 34 from outer faces 24 and 26 of partitions 20 and 22, respectively, to meet in central chamber 36 and are screwed tightly together until flanges 66, 68 abut outer faces 24 and 26. In order to screw parts 50 and 52 together, each end needs to be gripped by a suitable tool to enable adequate tightening. Access to outer faces 24 and 26 of both partitions 20 and 22 simultaneously, however, can be problematical and this process is further complicated by the fact that vortex finder 78 is formed as a separate part which is inserted into inlet opening 76 defined by hydrocyclone part 50 through its screw-threaded end which mates with part 52. The insertion of vortex finder 78 is an awkward operation since it is a close fit in its seat in part 50 but is small and not easy to manipulate. Also, although it is shaped to key with its seat in one specific orientation, there is no positive engagement between the two parts, and vortex finder 78 is held in position by clamping between the two interengaged parts 50 and 52. All of the parts must therefore be very precisely dimensioned in relation to each other and there is always a possibility of vortex finder 78 being accidentally shaken from its seat during the screwing together of parts 50 and 52.

An alternative prior-art hydrocyclone, disclosed in connection with a "Type C (Clamshell)" housing in a 1976 Dorr-Oliver brochure, used in a similar assembly as that shown in FIG. 1, is easier to assemble. Each C Type 10 mm hydrocyclone is formed in three parts, each injection molded in nylon. The components are a major annular body part, a tubular vortex finder and an apex nut which is hexagonal and internally threaded to mate with corresponding external threads on the annular body at the underflow end. The vortex finder has a hexagonal head forming a flange and a parallel threaded section below the head which threadably mates with corresponding threads internal to the annular body at the overflow end. The body can be inserted through the corresponding holes in the two partitions from the overflow side until the vortex finder head, serving as a stop member, abuts the outer face of the partition on the overflow end and the opposite underflow end projects through the other partition, on the underflow end. The apex nut is then screwed onto the projecting underflow end of the body and tightened into contact with the outer face of the partition on the underflow end, so that the hydrocyclone is clamped to the outer surfaces of the partitions, thereby placing hydrocyclones under tension.

A major problem with this alternative hydrocyclone arises. Precisely because of the screw-fitting of the vortex finder, it is difficult to provide a helical surface on the vortex finder, as will be described below with respect to the present invention, to improve the fluid flow into the hydrocyclone separating chamber. It is difficult because the vortex finder, and hence the helical surface, cannot be aligned accurately with the inlet. The hydrocyclone must, therefore, have relatively smaller dimensions and a correspondingly smaller throughput to achieve a given degree of separation. Considering assemblies including tens, or even a hundred or more, such hydrocyclones, it will be appreciated that even slight differences in throughput have an enormous effect on the overall performance of the assembly.

A further problem with this alternative construction is that, in use, the suspension to be separated is pumped into the central chamber of the separator assembly under considerable pressure and tends to force the partitions apart, thus putting the hydrocyclones under considerable strain, or tension. The strain reduces the working life of the hydrocyclones.

Furthermore, the alternative prior art hydrocyclone described above is used particularly in the food industry in a counter-current washing circuit in which clean wash water pumped in at one end separates gluten from corn starch, the clean corn starch exiting with the underflow while the gluten is washed out with the overflow. A further problem that arises with this use is that the hydrocyclones are made from NYLON, which reacts with sulfur dioxide used as a preservative in the corn starch and embrittles over the years. The combination of embrittlement and strain can lead to fracture of the hydrocyclone body, resulting in reduced capacity and performance, leading to production losses and to incurment of relatively high replacement costs. Another problem with the use of NYLON as a material of construction for hydrocyclones, is that the material tends to expand on contact with the slurry of water and processed corn during separation, and not uniformly.

Another type of separator assembly which uses a multitude of hydrocyclones is illustrated in "The DorrClone Hydrocyclone" sales brochure, 1984. These assemblies, in which one or both of the wall members is removable, are designated as "Type TM". The TM assemblies utilize 10 mm cyclones to wash starch in corn wet milling operations.

Each type TM hydrocyclone is formed in two parts, each injection molded from nylon, comprising a major annular body part and a tubular vortex finder, which fits by insertion into the body part. The major annular body part extends between its overflow end and opposite underflow end. The body part has an exterior defined by a semi-annular flange at its overflow end, which connects to a relatively short cylindrical portion of a smaller diameter than the flange. The short cylindrical portion further connects to a frusto-conical portion which tapers toward an annular radially projecting stop member, which has a diameter approximately equivalent to that of the flange. The stop member connects to a cylindrical boss of a smaller diameter, which in turn connects to relatively short frusto-conical transition portion. The transition portion connects to a frusto-conical spigot, which tapers to its apex at the underflow end. The semi-annular flange has a rectangular opening bounded on three sides therein connecting to a further rectangular opening, also bounded on three sides, formed in the relatively short cylindrical portion. A rectangle bounded on all four sides, constituting a tangential inlet opening, is formed by cooperation of the body part and the vortex finder. The vortex finder is provided with a frusto-conical guide surface, which projects and extends through the inlet chamber and terminates axially downstream of the tangential inlet when assembled with the body.

This separator assembly achieves good separation, but has certain problems and disadvantages.

These cyclones are used particularly in the food industry, particularly in corn wet milling, in a counter-current washing circuit in which clean wash water pumped in at one end separates gluten from corn starch, the clean corn starch exiting with the underflow while the gluten is washed out with the overflow. A problem that arises with this use is that the hydrocyclones are injection molded from NYLON. The NYLON reacts with sulfur dioxide, used as a preservative in the corn starch, and embrittles over the years. The combination of embrittlement and compression of the cyclones between the plates can lead to fracture of the hydrocyclone body, resulting in reduced capacity and performance, leading to production losses and to incurment of relatively high replacement costs.

The capacity and performance of the cyclones is further limited due to the overall external and internal configuration of the cyclone, which is the key parameter for optimal operation of hydrocyclones. The vortex finder is not provided with a helical guide surface, which would improve the fluid flow into cyclone separating chamber. Cyclones, therefore, have a relatively small throughput to achieve a given degree of separation. Considering assemblies including tens, or even a hundred or more, such hydrocyclones, it will be appreciated that even slight differences in throughput have an enormous effect on the overall performance of the assembly.

The present invention, therefore, seeks to provide hydrocyclones particularly of a type usable in the assemblies of the general type described above. An object of the present invention is to provide hydrocyclones which overcome the drawbacks and disadvantages of the prior art as discussed above.

An object of the present invention is to provide cyclones which are simpler to assemble and install, as well as to disassemble for repair or maintenance, than the known hydrocyclones described.

Another object of the present invention is to provide a better throughput for a given size of hydrocyclones, and thereby increase the capacity of the overall multi-cyclone separator assembly.

A further object is to provide hydrocyclones with a longer working life than the prior art hydrocyclones described.

Other objects of the present invention will become apparent from the detailed description which follows.

SUMMARY OF THE INVENTION

Accordingly, the invention provides hydrocyclones comprising a tubular body having an underflow end and an overflow end and having an interior defined by a cylindrical inlet chamber at the overflow end merging into an axially-extending frusto-conical separating chamber which tapers from the inlet chamber to an underflow outlet opening at the underflow end. For use in separating non-abrasive substances, such as corn starch, the hydrocyclones are preferably constructed by injection molding, from polypropylene material.

The body has a tangential inlet to the inlet chamber, preferably having a rectangular cross-section. The hydrocyclone further includes a vortex-finder member which fits through the overflow end of the body into a seat therein, the member seated in a predetermined position in which a portion thereof extends through the inlet chamber to define the axial overflow outlet from the separating chamber. The guide surface of the vortex finder preferably comprises a helical surface arranged to guide the inlet flow circumferentially and axially towards the separating chamber.

A further aspect the invention provides, in combination with the hydrocyclones of the present invention, a separator assembly having two opposing wall members defining an inlet chamber between them and having at least one pair of opposing apertures communicating with respective outlet chambers on the outer sides of the wall members and hydrocyclones as described above fitted and sealed in each said pair of opposing apertures so that the chambers are sealingly isolated from one another except through the hydrocyclones.

The hydrocyclones of one embodiment of the present invention may be adapted to be fitted into separator assemblies where the wall members are stationary, such as the "clamshell" housing. The hydrocyclones have a body which has a substantially cylindrical portion at its overflow end which connects to a substantially frusto-conical portion which tapers toward the underflow end and terminates in a frusto conical spigot. A portion of the spigot is surrounded circumferentially with a substantially cylindrical skirt. The skirt is radially spaced from the spigot, and terminates in a radially projecting stop member. The body can be inserted from the outer surface of one wall member through apertures in both wall members until a stop member at the underflow end abuts the outer surface of the wall member and a retaining member can be applied to the other end. The stop members of each of a plurality of hydrocyclones engage one another to prevent rotation of the hydrocyclones, and to allow for a maximum density of hydrocyclones. The hydrocyclone body is preferably provided with support means for the protruding underflow outlet, which also ensure that the underflow outlet is aligned with the overflow outlet.

A retaining member for retaining the hydrocyclone body in its position of use is also adapted to retain the vortex-finder member in its seat. Preferably, the retaining member allows the hydrocyclone body a small amount of axial movement in the wall member apertures, such as to accommodate the outward movement of the wall members under pressure and dimensional changes caused by differential expansion.

In a variation on this first embodiment of the present invention, the spigot is eliminated. Underflow outlet is instead defined at the apex of the frusto-conical portion, which terminates in the interior of the cylindrical skirt.

The cyclones of another embodiment may be fitted into separator assemblies of the type where one or both of the wall members is removable. The cyclone body that is intended for use in starch washing operations has an exterior defined by an annular flange, which connects to a relatively long cylindrical portion of a smaller diameter, having a stop member projecting radially therefrom and further connecting to a cylindrical boss of a smaller diameter, which, in turn, connects to a frusto-conical spigot which tapers toward the underflow end to its apex. The flange has a U-shaped detent therein. The cylindrical portion is relatively long, spanning the entire distance between the overflow end of the cyclone and the stop member thereof, coupled with the cylindrical boss, such that the cyclone begins to taper to the frusto-conical spigot only at that point where the cyclone protrudes past the wall member on the underflow end. The cyclone is further comprised by a vortex finder which can be inserted through the cyclone body cavity to snap in with the D-ring on the main body of the vortex finder against the groove into the bore of the cyclone body, while a peg projecting from the main body of the vortex finder engages in the U-shaped detent in the flange of the cyclone body. The hydrocyclones can be inserted from the inner surface of the wall member on the underflow end, by their underflow ends first, through apertures in the wall member, until the stop member abuts the inner surface. The other wall member is then fitted over the overflow ends of the cyclones such that the overflow ends fit into respective apertures.

In a variation on this embodiment, intended for thickening operations, the cyclone body has an exterior defined by an annular flange at its overflow end, which connects to a cylindrical portion of a smaller diameter than the flange, which connects to a frusto-conical portion which tapers toward an annular radially projecting stop member. The stop member connects to a cylindrical boss of a smaller diameter, which in turn connects to relatively short frusto-conical transition portion, which connects to a frusto-conical spigot. A rectangular opening is formed in the cylindrical portion. The same "snap-in" vortex finder as used for the washing type cyclone is used with the thickening cyclone.

The invention further relates to processes of purifying corn starch using the hydrocyclones and the separator assemblies of the present invention, and to the purified corn starch product achieved by such processes.

BRIEF DESCRIPTION OF THE DRAWINGS

Some of the objects of the invention have been stated and others will become apparent as two embodiments of the invention and their variations will now be more particularly described, by way of example, with reference to the accompanying drawings, in which.

DETAILED DESCRIPTION OF THE INVENTION

Figure 1:
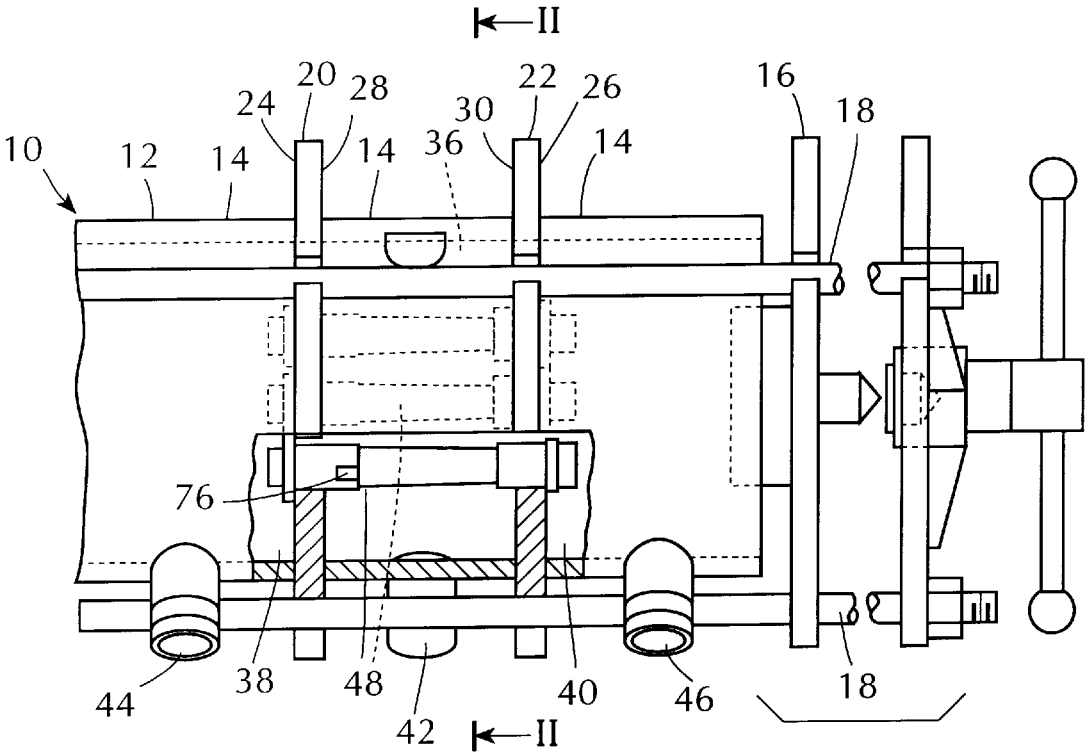
FIG. 1 PRIOR ART
FIGS. 1, 2, and 3 relate to prior art apparatus and have already been described.
Figure 4:
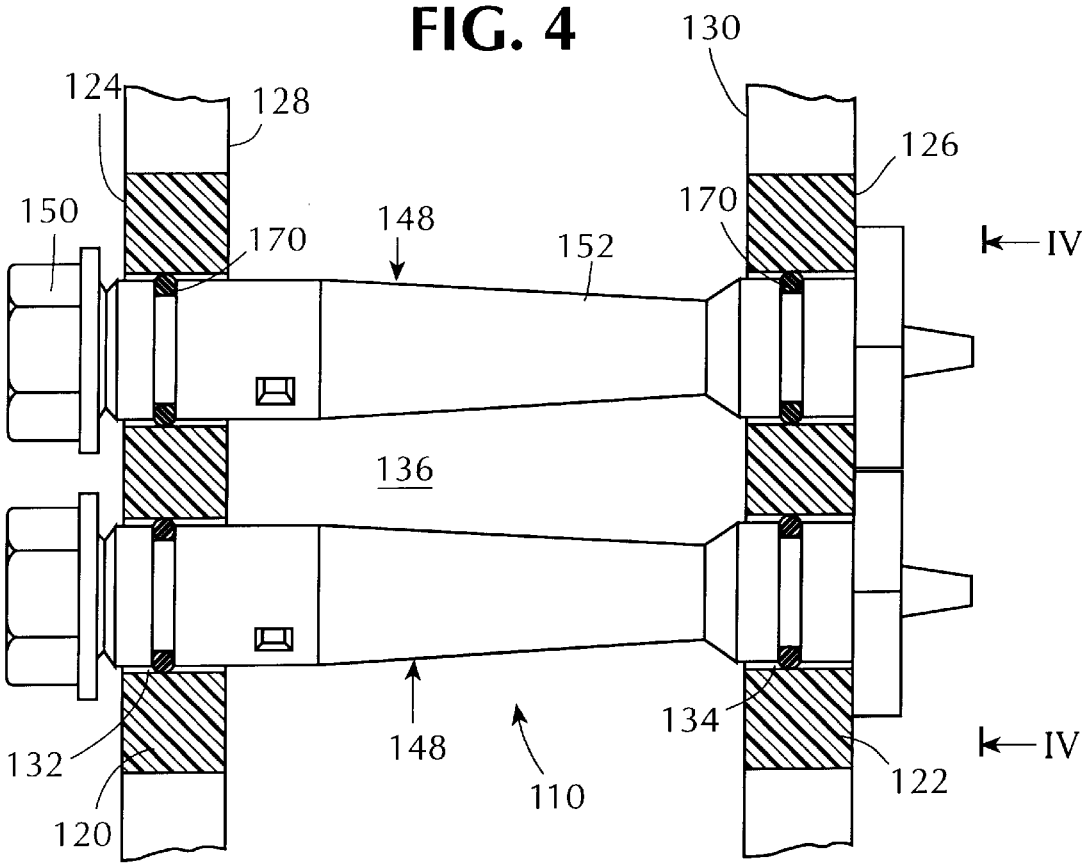
FIG. 4 is a part-sectioned elevational view showing part of the assembly of FIG. 1 on an enlarged scale but fitted with hydrocyclones according to the first embodiment of the invention.

With reference to FIG. 4, part of assembly 10 of FIG. 1 comprising two partitions 120 and 122, their outer faces 124, 126 and opposing inner faces 128, 130, apertures 132 and 134, and central inlet chamber 136 defined between them is shown. The difference between assembly 110 of FIG. 4 and assembly 10 of FIG. 1 is that hydrocyclones 48 are replaced by hydrocyclones generally indicated 148, according to the invention, only two of which are shown for simplicity of illustration. Each hydrocyclone 148 is formed in three parts, each injection molded from polypropylene, comprising a major annular body part 152, a tubular vortex finder 178 (shown in FIGS. 5 and 7), which fits by insertion into body part 152, and an annular end cap 150, or retaining member, which threadedly mates with body part 152, although other forms of engagement may readily be envisaged. O-rings 170 again are provided as seals between the cylindrical surfaces defining apertures 132 and 134 and outlet chambers 138 and 140 (which correspond to chambers 38 and 40 discussed with reference to FIG. 1). Each hydrocyclone 148, once fitted in assembly 110, functions like the prior art clamshell type hydrocyclone and has similarly arranged functional parts. However, hydrocyclones 148 embody key structural differences relative to the Type C hydrocyclones described above and provide unexpected advantages over the Type C hydrocyclones.

Figure 5:
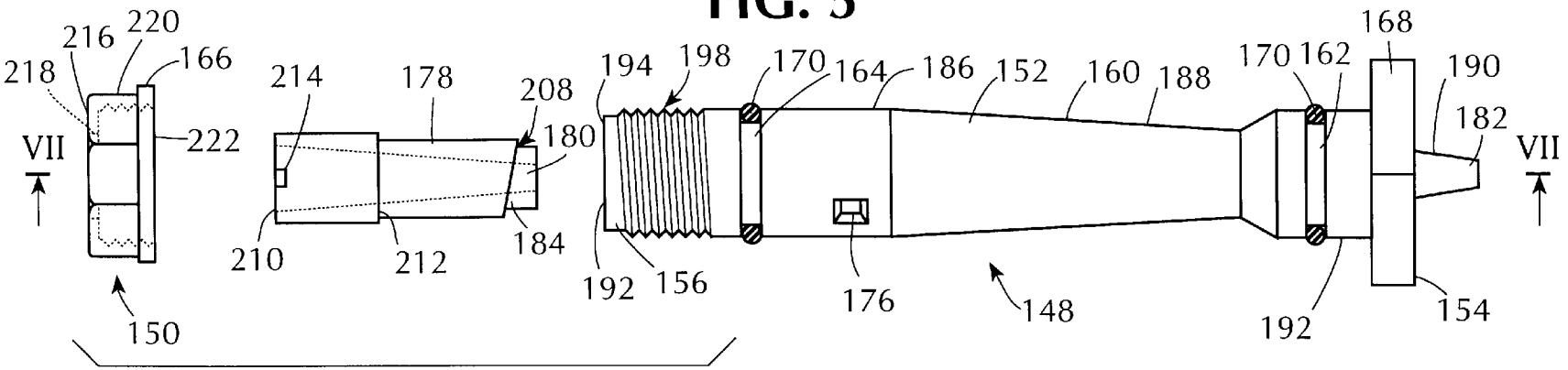
FIG. 5 is an elevational view of one of the hydrocyclones of FIG. 4 showing the parts separated.

With reference to FIG. 5, body part 152 has overflow end 156, an opposite underflow end 154, and is defined by outer surface 160 extending therebetween. Outer surface 160 of part 152 has a substantially cylindrical portion 186 at overflow end 156 which connects to a substantially frusto-conical portion 188 which tapers toward end 154 and terminates in frusto conical spigot 190 which defines underflow outlet 182. A portion of spigot 190 is surrounded circumferentially with a substantially cylindrical skirt 192. Skirt 192 is radially spaced from spigot 190, and is of substantially the same external diameter as portion 186. Skirt 192 terminates in radially projecting stop member, or end flange 168. The entirety of body part 152 is of smaller diameter than apertures 132 and 134, except for flange 168, which has a larger diameter for abutting outer face 126 of partition 122. End flange 168, preferably, is of hexagonal cross-section. Annular grooves 162 and 164 are formed in skirt 192 and portion 186 adjacent opposite ends 154 and 156 of part 152, respectively, for holding O-rings 170.

Figure 6:
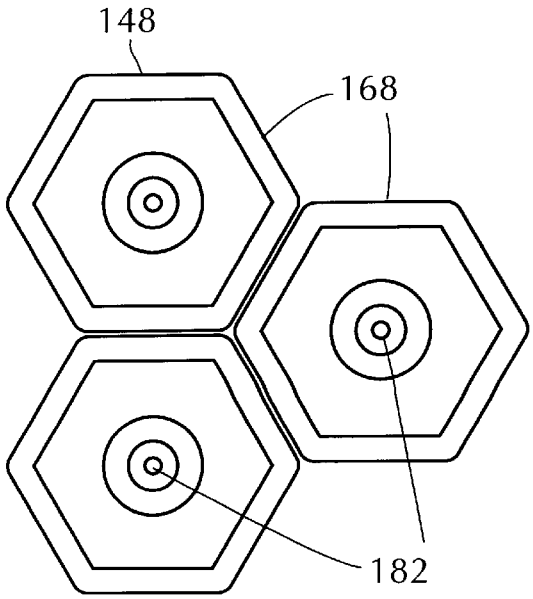
FIG. 6 is an end view taken on arrow VI of FIG. 4 showing the ends of three hydrocyclones of the invention.

With reference to FIG. 6, underflow ends 154 of three hydrocyclones 148 having hexagonal end flanges 168 and underflow axial outlets 182 are shown. Flanges 168 of hydrocyclone body part 152 are of such a size and apertures 134 in partition 122 are so arranged that end flanges 168 of adjacent hydrocyclone parts 152 almost touch each other. In the case of hydrocyclones 148 having a 12 mm diameter, a clearance of about ½ mm is allowed between flanges 168.

Figure 7:
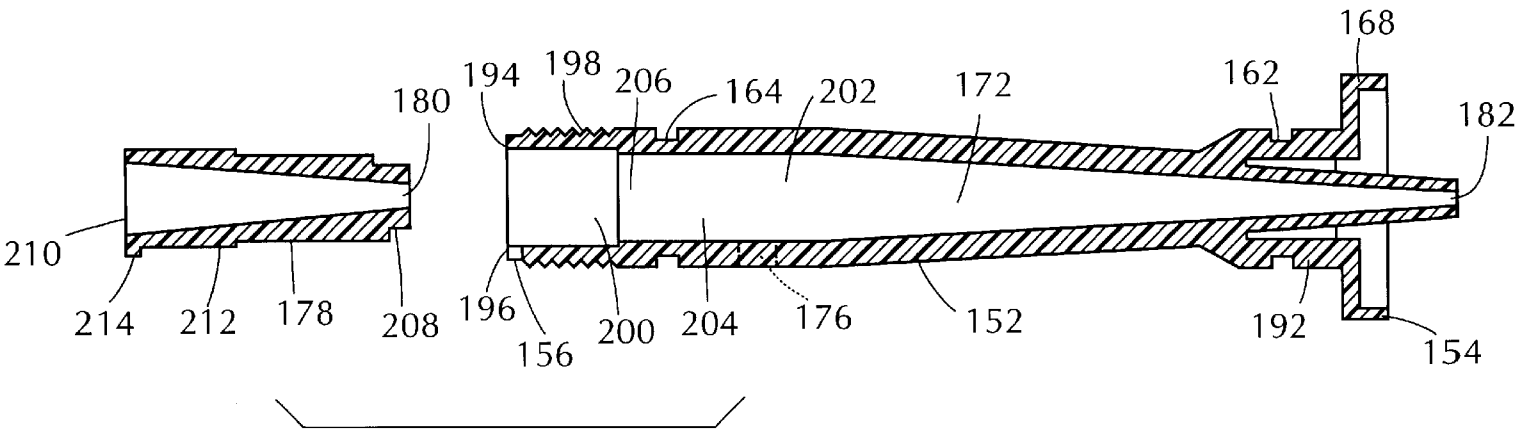
FIG. 7 is an axial sectional view taken on the line VII—VII of FIG. 5.

With reference to FIG. 7, overflow end 156 of hydrocyclone part 152 defines end face 194 with detent 196 therein and has external screw threading at 198 adjacent end face 194. Part 152 has an interior defined by cylindrical bore 200 extending from end face 194 toward hydrocyclone inlet chamber 202 and communicating with chamber 202 through a farther cylindrical bore 204 of the same diameter as chamber 202 but slightly narrower than bore 200. Body part 152 is further provided with internal shoulder 206 between the wider and narrower bores 200 and 204, respectively. The interior of part 152 further extends from inlet chamber 202 to frusto-conical separating chamber 172.

With reference to FIGS. 5 and 7, a rectangular tangential inlet opening 176 opens from central inlet chamber 136 to hydrocyclone inlet chamber 202 which extends into frusto-conical chamber 172 tapering to a second, underflow axial outlet 182. Overflow outlet 180 and underflow outlet 182 communicate with outlet chambers 138 and 140 respectively.

Tubular vortex finder 178 has end portion 208 at one end thereof, axial annular end face 210 at the opposite end thereof, and external shoulder 212 defined therebetween. A small tooth 214 projects radially from end face 210. Vortex finder 178 is provided with a helical ramp surface 184 at end portion 208 arranged to guide an inlet flow circumferentially and axially toward frusto-conical separating chamber 172. Ramp surface 184 serves the same function as helical channel 84 in the prior art vortex finder 78. Ramp surface 184 is sized and shaped to match inner surfaces of bores 200 and 204.

With reference to FIG. 5, annular end cap 150, serving as a retaining member, has end wall 21 at one end thereof with a circular aperture 218 therein, an outwardly projecting annular cap flange 166 at the other end thereof, and a cylindrical body 220 extending therebetween. Body 220 has an outer surface of polygonal, preferably hexagonal, cross-section. Flange 166 is of larger diameter than aperture 134. End cap 150 has an annular internal end face 222 formed therein, which has internal screw threading sized and fitted to cooperate with external screw threading 198 on part 152.

During assembly, major body part 152 of hydrocyclone 148 is sufficiently long to extend right through the two partitions 120 and 122. Part 152, having a smaller diameter than apertures 132 and 134, can be inserted through apertures 132 and 134 of partitions 120 and 122 from outer face 126 of partition 122, until flange 168 abuts outer face 126 at apertures 134. When assembled in assembly 110, overflow end 156 projects from outer face 124 of partition 120 to expose external screw threading at 198 for engagement with cap 150. Underflow outlet 182 projects from outer face 126 of partition 122 past flange 168. Expansion of body part from conical, at portion 188, to cylindrical, at portion 192, allows a seal to be formed between body part 152 and aperture 134.

Continuing with the assembly of the separator, cap nut 150 is screwed onto part 152 by means of cooperation of internal screw threading at end face 222 of cap 150 with external screw threading 198 on part 152. Once cap 150 is screwed onto body part 152, it prevents body part 152 from being withdrawn through apertures 132 and 134, thereby retaining hydrocyclones 148 in their positions. Cap 150 is, however, of such a length axially that when annular internal end face 222 of cap 150 abuts axial annular end face 194 of body part 152, with the opposite end flange 168 abutting wall 122, cap flange 166 is spaced from the outer face 124 of partition 120. For example, in the case of hydrocyclone 148 having a 12 mm diameter, cap flange 166 is spaced a minimum of 1 mm and a maximum of 5 mm from face 124. Flanges 166, 168 do not, therefore, clamp walls 120 and 122 between them. Instead, body part 152 is free to slide axially in apertures 132 and 134 to a small extent determined by the clearance between cap flange 166 and partition 120 so that it is not subject to stress in use when inlet chamber 136 is pressurized. The hydrocyclone is thus not stressed in use and may have a relatively long working life due to the minimized tension.

Figure 2:
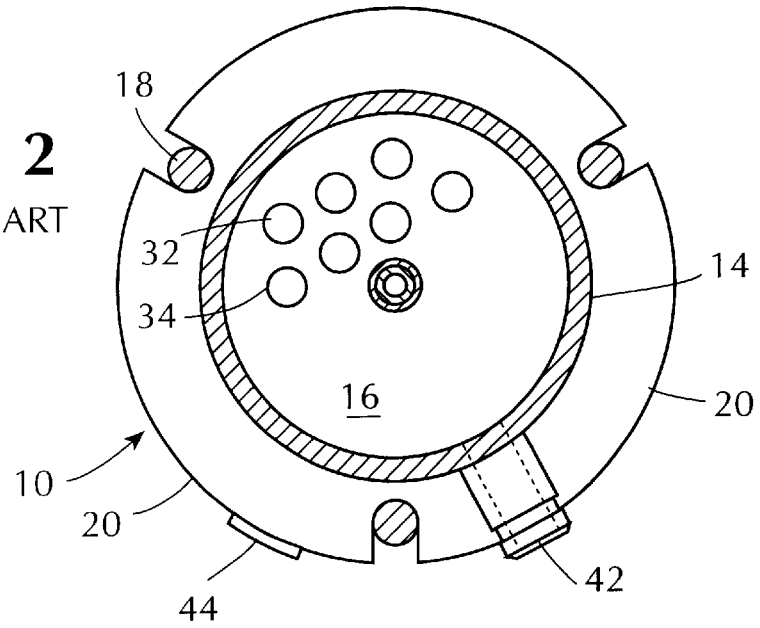
FIG. 2 PRIOR ART
Figure 3:
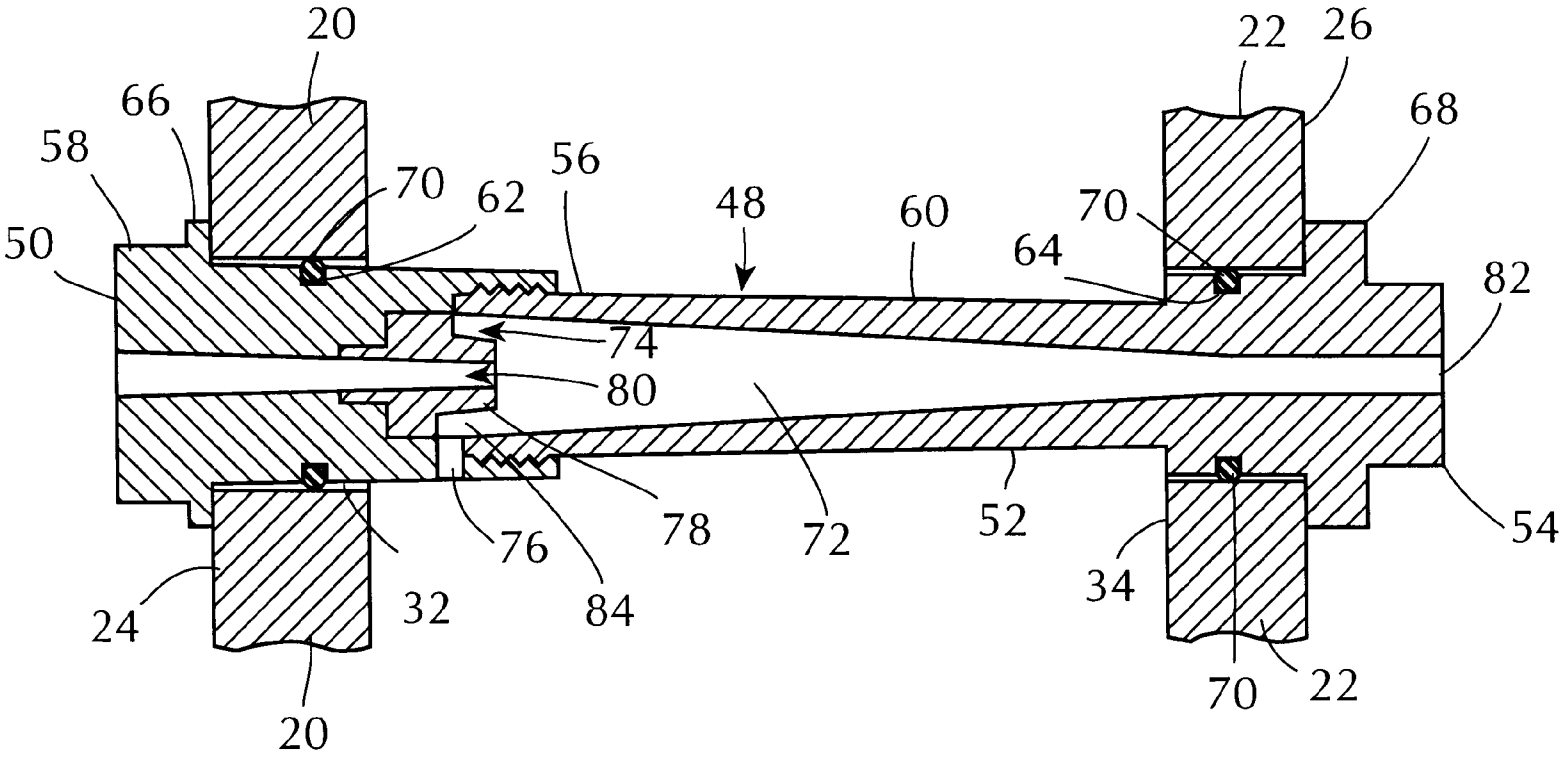
FIG. 3 PRIOR ART

As discussed above, with reference to FIG. 6, in the case of hydrocyclone 148 having a 12 mm diameter, a clearance of about ½ mm is allowed between flanges 168 to facilitate insertion and allow for any irregularity in the spacings of apertures 132 or 134. However, flanges 168 are sufficiently close that when the plurality of hydrocyclone body parts 152 are fitted through their respective apertures 134 and 132 during assembly of separator 110 of FIG. 4, all their flanges 168 cooperate with each other to prevent hydrocyclones 148 from rotating about their respective axes. Thus, in order to screw end caps 150 onto hydrocyclone body parts 152 there is no need to grip end flanges 168. Tools are needed solely to manipulate caps 150 so that access is required solely to outer face 124 of partition 120 and assembly and disassembly is much facilitated compared with that required for the prior art assembly of FIGS. 1 to 3. The hexagonal arrangement likewise prevents the tendency of hydrocyclones 148 to rotate during operation of separator assembly 110 due to the drag of slurry entering hydrocyclones 148 through tangential inlet opening 176. Additionally, hexagonal end flanges 168 allow for a maximum number of hydrocyclones 148 to be installed in a given area, i.e., a densest arrangement. This is an advantage because the capacity of separator assembly 110 is determined not only by the size, but also by the number of hydrocyclones 148.

Another advantage of this embodiment of the present invention is in the configuration and fitting of vortex finder 178. Vortex finder 178 has helical ramp surface 184 which matches that of bores 200 and 204 such that it can be inserted into them through end face 194 to seat with external shoulder 212 against internal shoulder 206 of body part 152 between the wider and narrower bores 200 and 204, respectively. In its inserted position, end portion 208 of vortex finder 178, which has helical ramp surface 184, projects into and extends through hydrocyclone inlet chamber 202 to define axial overflow outlet 180 from separating chamber 172. A small tooth 214 projects radially from end face 210 of vortex finder 178 and is engageable in a cooperating detent 196 in end face 194 of hydrocyclone body part 152 to ensure that helical surface 184 is aligned correctly with tangential inlet opening 176 to inlet chamber 202.

In its inserted position, end face 210 of vortex finder 178 is substantially flush with end face 194 of hydrocyclone body part 152. Vortex finder 178 may thus be retained in its seat by the fitting of cap 150 onto overflow end 156 of body part 152, with internal end face 222 of cap 150 abutting end face 210 of vortex finder 178, although other forms of engagement and retainment may readily be envisioned. When vortex finder 178 and cap 150 are so fitted, outlet 180 from hydrocyclone 148 is defined by the axial cavity within vortex finder 178 which communicates with aperture 218 in end wall 216 of cap 150.

It will be appreciated that vortex finder 178 is much simpler to insert and retain in major body part 152 during the fitting of cap 150 and assembly of apparatus 110 of FIG. 4 than the prior art vortex finder 78.

Figure 8:
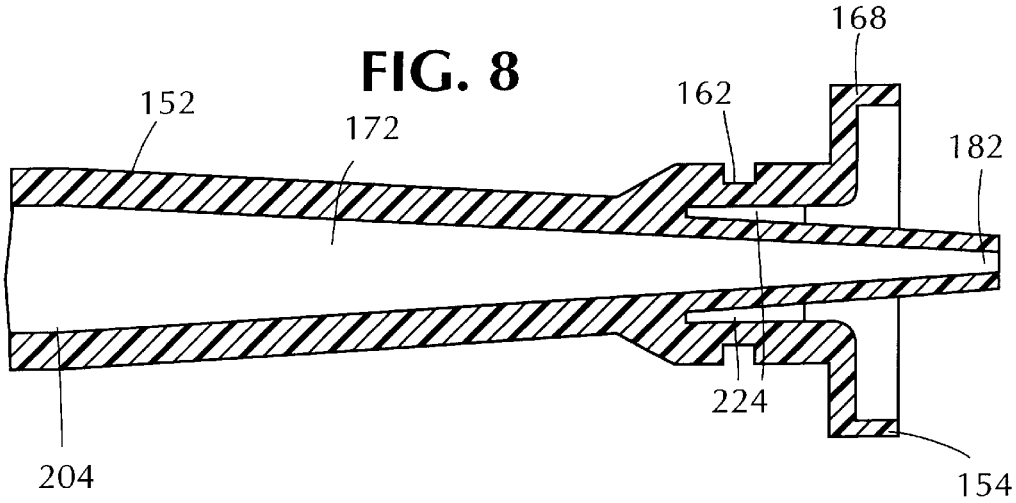
FIG. 8 is a view of the underflow end of FIG. 7, illustrating an additional feature of the preferred variation of the embodiment of the present invention discussed in relation to FIGS. 4–7.
Figure 9:
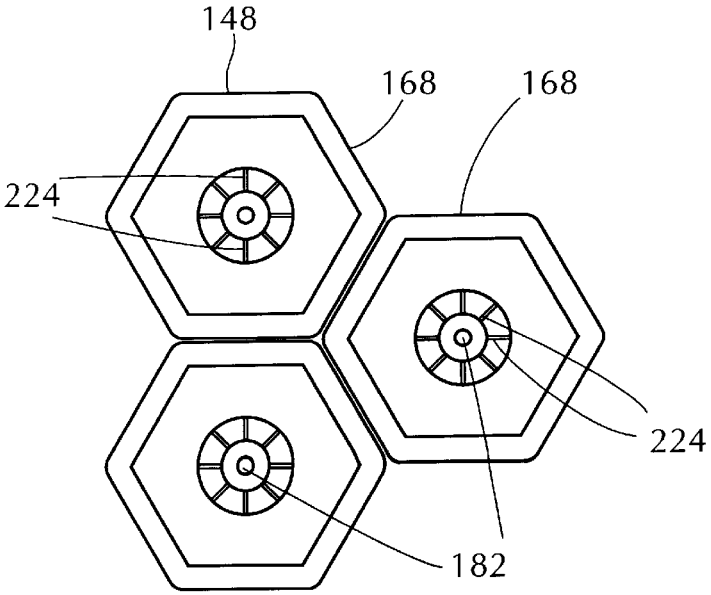
FIG. 9 is an end view of FIG. 6, showing the underflow ends of three hydrocyclones of the invention, and illustrating the additional feature of the preferred variation.

As a further example, in another variation on this embodiment of the present invention, body 152 is optionally but preferably provided with support means comprising eight support gussets 224 formed as part of body 152 and integral therewith, between the interior of skirt 192 and the part of spigot 190 surrounded by skirt 192, as shown in FIGS. 8 and 9. Fewer or more support gussets 224 may be used. Gussets 224 provide support for protruding underflow outlet 182 and thereby ensure that underflow outlet 182 is aligned with overflow outlet 180 and is coaxial with bores 200 and 204. Use of support gussets 224 results in improved reproducibility of separation results.

Figure 5A:
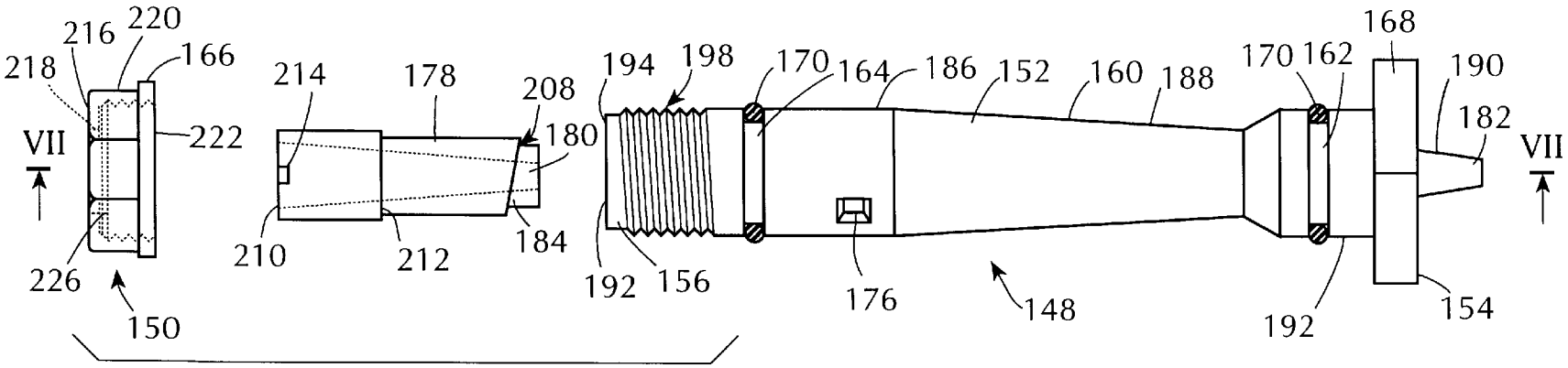
FIG. 5A is an elevational view of an alternative embodiment of one of the hydrocyclones of FIG. 4 showing the parts separated.

As a still further example, in still another variation on this embodiment of the present invention, cap nut 150 is replaced with blank insert 226 as shown in FIG. 5A, wherein insert 226 has the same external configuration as nut 150, but aperture 218 in cap nut 150 is plugged. This feature makes system expansion a very cost effective option because all that is needed is cap nut 150 to replace blank insert 226, as both use a common body 152. When using blank insert 226, vortex finder 178 may be omitted. A blank body may also be used, where the interior has been plugged, but which has an exterior the same as body 152. The ready interchangeability provides a wide range of flow capacities and characteristics. In some instances, it may be desired to reduce the flow capacity by replacing one or more nuts 150 with blank insert 226.

In still another variation on this first embodiment of the present invention, the hydrocyclone is essentially the same in all respects as hydrocyclone 148, except that spigot 190 is eliminated. Underflow outlet 182 is instead defined at the apex of frusto-conical portion 188, which terminates in the interior of cylindrical skirt 192. Gussets 224 may be used in this variation, as well, and would be situated at the apex of portion 188 and integral with skirt 192.

Figure 10:
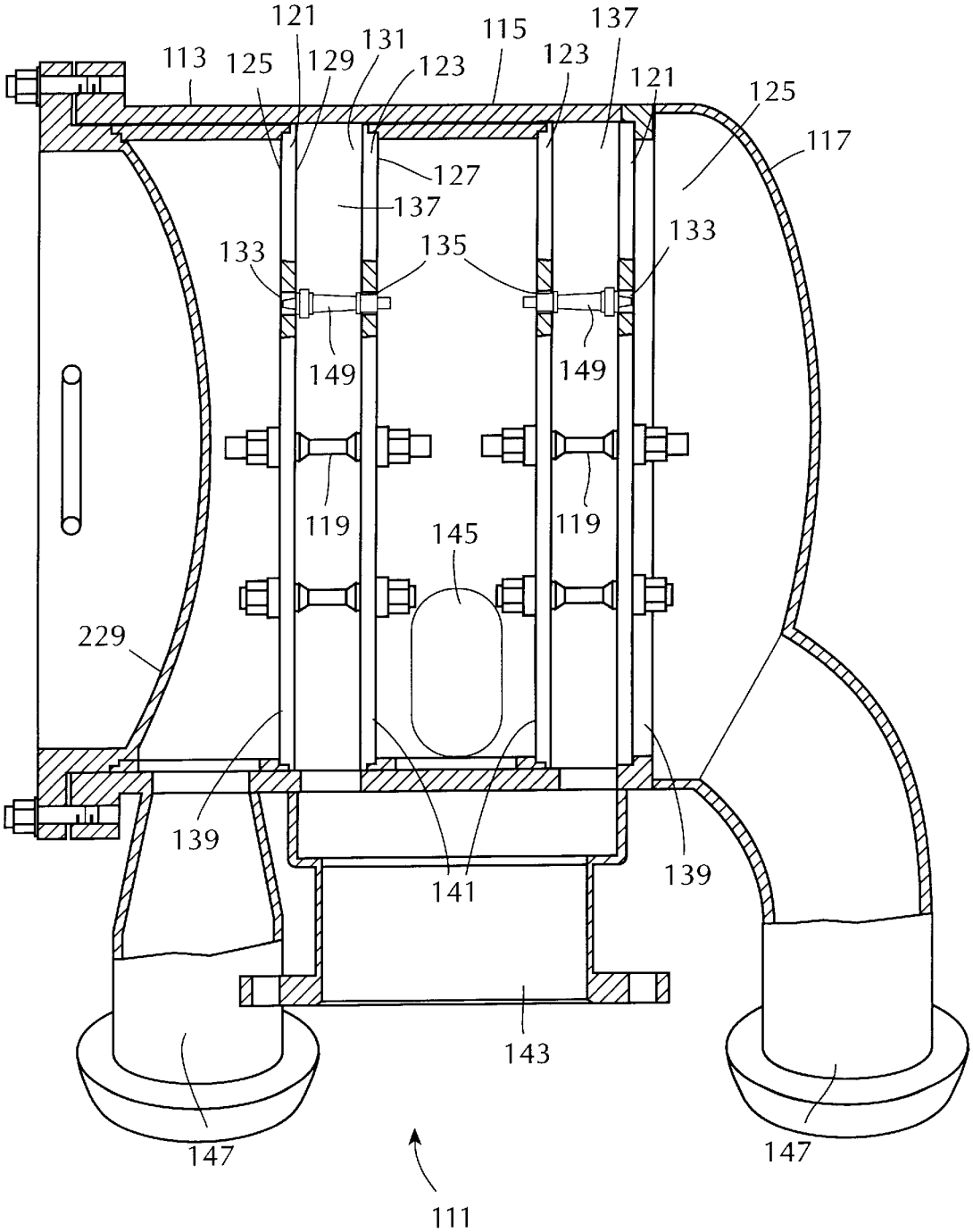
FIG. 10 is a schematic, partially sectioned side elevational view of part of the separator assembly housing the cyclones of the second embodiment of the present invention.

Turning now to another embodiment of the present invention, with reference to FIG. 10, a part of separator assembly generally indicated 111 is shown. Separator assembly 111 has a generally cylindrical casing 113, only one end portion of which is shown, and which is constituted by annular walls 115 and semi-elliptical end walls 117. Walls 115, 117 are welded together at various points (not shown). Two pairs of opposing wall members, or partitions 121, 123 are shown. One or both of the partitions 121, 123 may be removable. Alternatively, partition 123, on the underflow end 155, is permanently mounted. Casing 113 may include any number of such pairs of partitions 121, 123, compartmentalized by the inclusion of detachable doors, such as door 229 bolted to casing 113 and made detachable for access to the interior of casing 113 and removal of partitions 121, 123. Casing 113 as shown in FIG. 10 is arranged in a horizontal plane.

Partitions 121, 123 each have outer faces 125, 127 and opposing inner faces 129, 131, respectively. Optionally, conventional tightenable bolt members 119, are provided to link partitions 121, 123, keeping them spaced apart. Each partition 121, 123 has a plurality of circular apertures 133, 135, respectively, arranged in regular two dimensional arrays. Apertures 133, 135 in each pair of partitions 121, 123 are axially aligned.

Partitions 121, 123 define central inlet chamber 137 between their opposing faces 129, 131 and overflow and underflow outlet chambers 139, 141 respectively, adjacent their outer faces 125, 127, respectively. Inlet duct 143 opens into each of a plurality of central inlet chambers 137 while outlet ducts 145, 147 open from outlet chambers 141, 139 respectively.

Inlet chamber 137 does not communicate directly through apertures 133, 135 in partitions 121, 123 with outlet chambers 139, 141 but through hydrocyclones 149 (also known as cyclones or cyclonettes), each of which extends parallel to chamber 137 axis. Cyclones 149 embody key structural differences relative to the cyclones of the prior art, described with reference to the TM type housings, and provide unexpected advantages. Assembly 111 may hold cyclones 149W, intended for starch washing operations, or cyclones 149T, intended for thickening operations. Cyclones 149W and 149T will be described in more detail presently.

Figure 11:
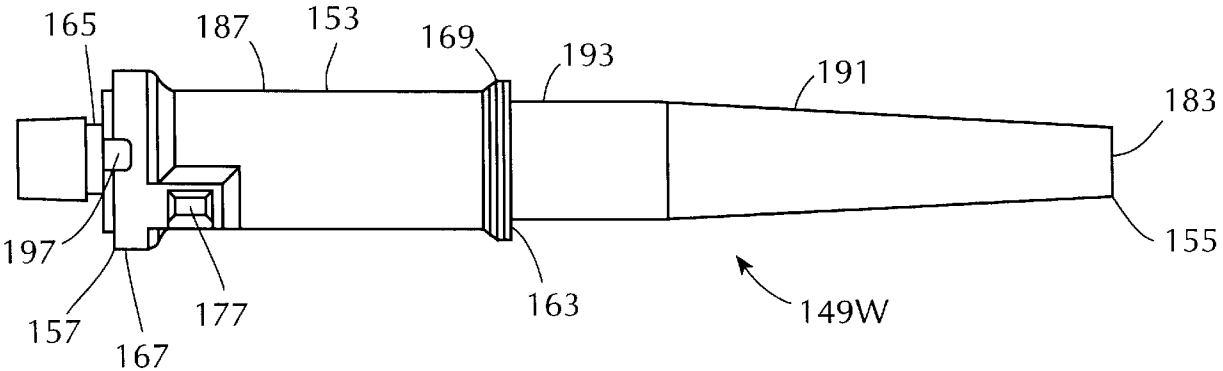
FIG. 11 is an elevational view of a cyclone of the second embodiment of the present invention.

With reference to FIG. 11, major annular body part 153 of cyclone 149W, preferably used for starch washing operations, extends between its overflow end 157 and opposite underflow end 155. Body part 153 has an exterior defined by annular flange 167, which connects to a relatively long cylindrical portion 187 of a smaller diameter, having annular flange 169 projecting radially therefrom and further connecting to cylindrical boss 193 of a smaller diameter, which, in turn, connects to frusto-conical spigot 191 which tapers toward underflow end 155 to its apex. Flange 167 has a U-shaped detent 197 therein. Substantially cylindrical outer portion 187 is relatively long, spanning substantially the entire distance between flange 167 of cyclone 149 and flange 169 thereof, coupled with cylindrical boss 193, such that body part 153 begins to taper to frusto-conical spigot 191 only at that point where cyclone 149W protrudes past wall 123 (see also FIG. 12).

Portion 187 has a substantially rectangular tangential inlet opening 177 formed therein, at overflow end 157 thereof. Rectangular opening 177 opens into inlet chamber 203 from central chamber 137.

Figure 12:
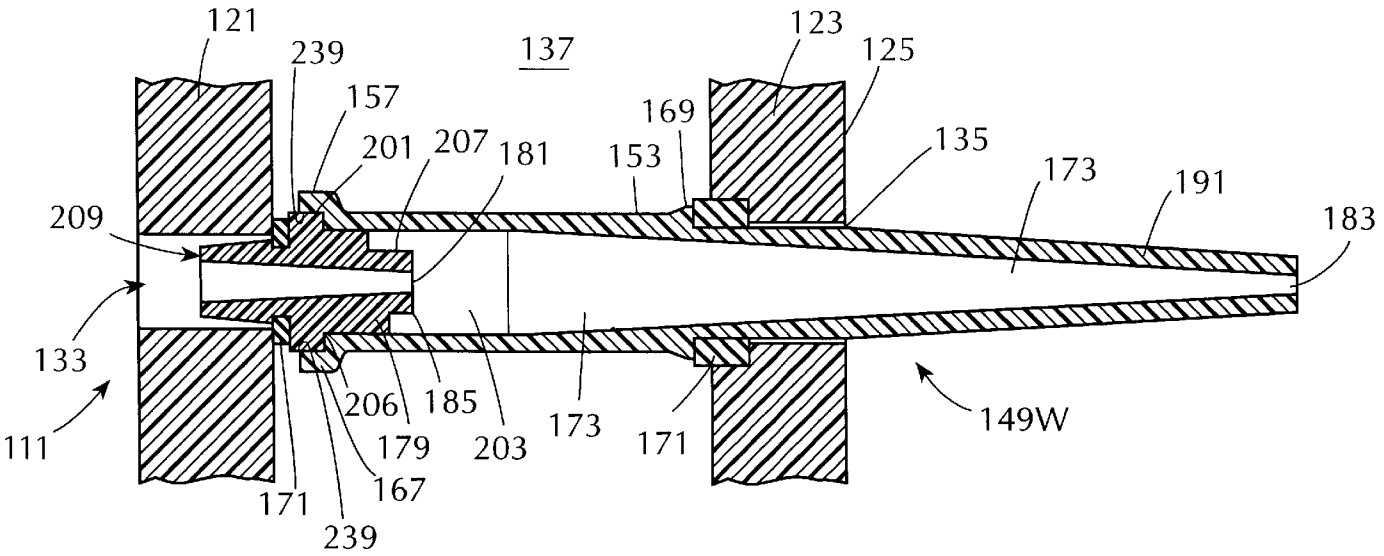
FIG. 12 is an axial sectional view of the cyclone of FIG. 11 fitted in part of the assembly of FIG. 10.

With reference to FIG. 12, part 153 of cyclone 149 has an interior defined in several inter-connected segments. At overflow end 157, cylindrical bore 201 is formed in flange 167, and in that portion of the interior wall of flange 167, groove 239 (not shown) is provided. Bore 201 extends from overflow end 157 in the direction of underflow end 155 and connects to relatively long cylindrical hydrocyclone inlet chamber 203. The diameter of chamber 203 is slightly narrower than that of bore 201, with internal shoulder 206 formed between the wider bore 201 and inlet chamber 203. Inlet chamber 203 communicates directly with central inlet chamber 137. Relatively long cylindrical inlet chamber 203 spans past opening 177 (for better separation) and connects to frusto-conical separating chamber 173, which extends and tapers between inlet chamber 203 and underflow end 155. Underflow end 155 of hydrocyclone 149W has a second axial outlet 183, an aperture formed at the apex of portion 191. Outlet 183 communicates with underflow outlet chamber 141, and is known as the underflow outlet.

Figure 13:
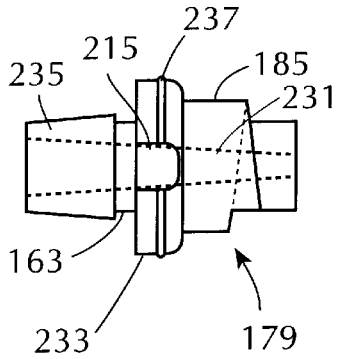
FIG. 13 is an elevational view of a vortex finder of the second embodiment of the present invention.

With reference to FIG. 13, vortex finder 179 has frusto-conical interior 231 and an exterior defined by helical guide surface 185, connected to substantially cylindrical main body 233 of a substantially larger diameter than guide surface 185, cylindrical internal shoulder 163 defined between body 233 and frusto-conical terminal portion 235. Vortex finder 179 is provided with a helical ramp on guide surface 185 to guide an inlet flow circumferentially and axially toward frusto-conical separating chamber 173, thereby reducing the turbulence that would arise with a purely cylindrical or conical guide surface. Main body 233 has peg 215 projecting therefrom and is molded with D-ring 237.

Helical surface 185 matches that of inlet chamber 203 such that it can be inserted into it through bore 201 to snap in with D-ring 237 into groove 239, with body 233 against bore 201, while peg 215 engages in cooperating detent 197, to prevent vortex finder 179 from falling out during assembly and operation of cyclone assembly 111. In its inserted position, helical guide surface 185, projects into and extends through inlet chamber 203 to define axial overflow outlet 181 from separating chamber 173. Vortex finder 179 is located permanently by means of D-ring 237 in cyclone 149 prior to assembling separator assembly 111. It will be appreciated that vortex finder 179 is much simpler to retain in major body part 153 during assembly and operation of apparatus 111 than the prior art vortex finder.

Figure 12A:
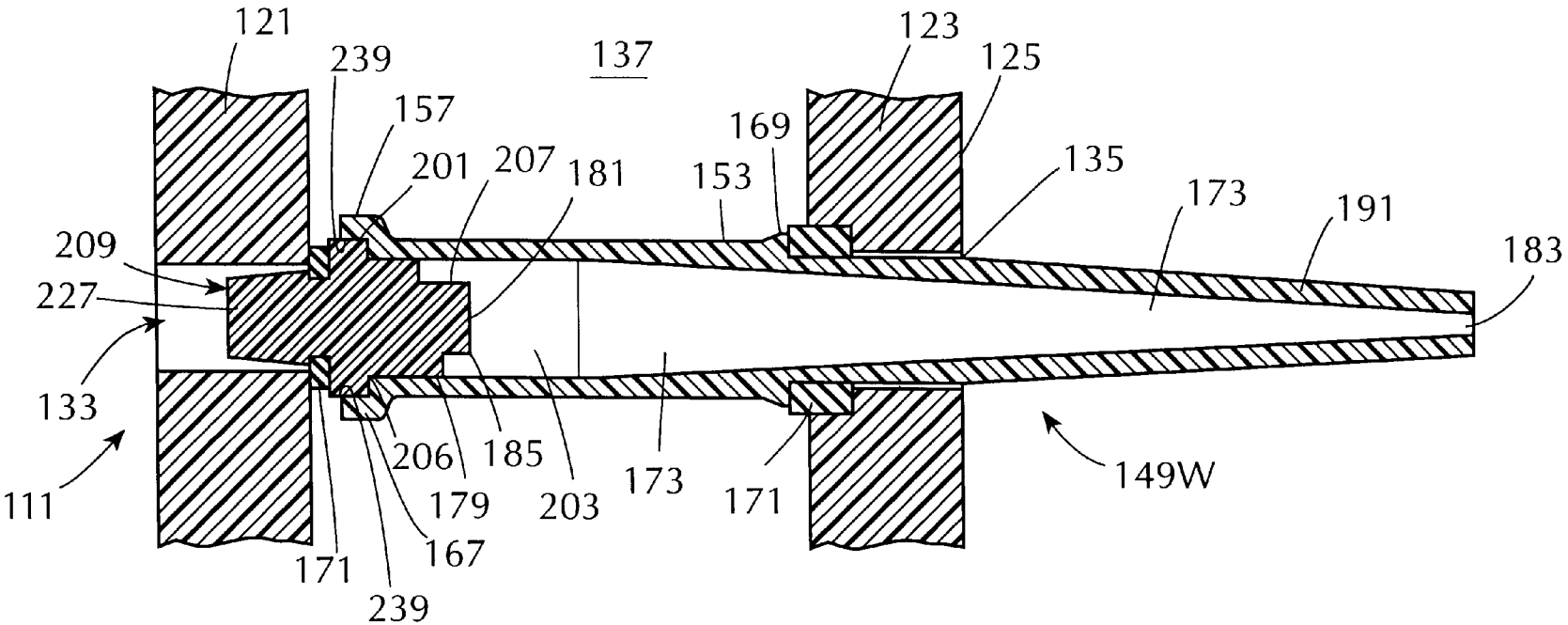
FIG. 12A is an axial sectional view of an alternative embodiment of the cyclone of FIG. 11 fitted in part of the assembly of FIG. 10.

An alternative to vortex finder 179 is a blank insert 227 as shown in FIG. 12A, wherein interior 231 of vortex finder 179 is plugged. This feature makes system expansion a very cost effective option because all that is needed to increase capacity is vortex finder 179 to replace blank insert 227, as both use a common body 153. The ready interchangeability provides a wide range of flow capacities and characteristics.

Figure 14:
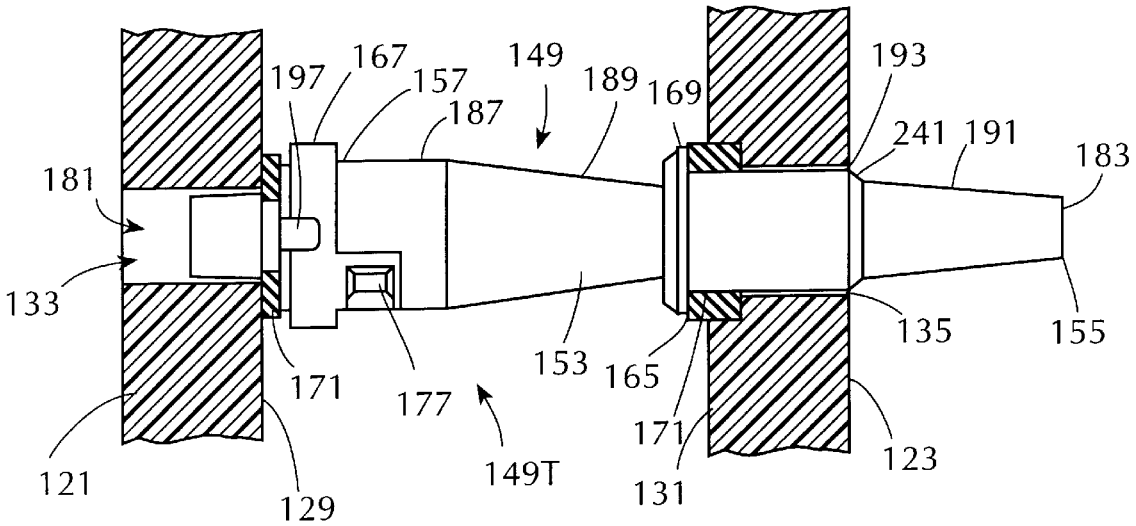
FIG. 14 is an elevational view of a variation of a cyclone of the second embodiment of the present invention, preferably intended for thickening operations.

FIG. 14 depicts a variation on this embodiment of the present invention, cyclone 149T intended for thickening operations. Major annular body part 153 extends between its overflow end 157 and opposite underflow end 155. Body part 153 has an exterior defined by annular flange 167 at its overflow end 157, which connects to cylindrical portion 187 of a smaller diameter than flange 167. Portion 187 further connects to frusto-conical portion 189 which tapers toward annular radially projecting stop member, or flange 169, which has a diameter approximately equivalent to that of flange 167. Flange 169 connects to cylindrical boss 193 of a smaller diameter, which in turn connects to relatively short frusto-conical transition portion 241. Transition portion 241 connects to frusto-conical spigot 191, which tapers to its apex at underflow end 155. Annular flange 167 has U-shaped detent 197. Rectangular opening 177 is formed in portion 187. Body 153 has axial inlet cavity 175 formed at overflow end 157 thereof. Rectangular tangential inlet opening 177 opens into cavity 175 from central chamber 137. The internal configuration of cyclone 149T is the same as that of cyclone 149W, described with reference to FIG. 12. Cyclone 149T may be fitted with the same "snap-in" vortex finder 179 as that for washing cyclone 149W, or with blank insert 227.

During assembly, major body part 153 of hydrocyclone 149 can be inserted from inner face 131 of partition 123 by its underflow end 155 first, through apertures 135 in partition 123, until flange 169 abuts inner face 131. Partition 121 is then fitted over overflow ends 157 of cyclones 149 such that overflow ends 157 fit into respective apertures 133 in partition 121, which is stopped by main body 233 of vortex finder 179 through gasket 171. Once partition 121 is fitted over cyclone 149, it prevents cyclone 149 from being withdrawn through apertures 133 and 135, thereby retaining hydrocyclones 149 in their positions. Bolt members 119 are placed to extend between partitions 121, 123 and tightened, thereby compressing cyclones 149 between plates 121, 123. With the help of gaskets 171, this compression maintains a seal, such that communication between inlet chamber 137 and outlet chambers 139, 141 is by means of cyclones 149. When assembled in assembly 111, underflow outlet 182 projects from outer face 125 of partition 123. Expansion of body part from conical, at portion 191, to cylindrical, at boss 193, allows a seal to be formed between body part 153 and aperture 135.

In use of assembly 111, a suspension to be classified is pumped under pressure through inlet duct 143 (FIG. 10), where the flow is split such that chamber 137 of each of a plurality of pairs of partitions 121, 123 is fed. Gaskets 171 provide a seal at partitions 121 and 123 between chamber 137 and chambers 139 and 141, so that the flow in chamber 137 is forced through tangential inlet openings 177 of hydrocyclones 149 into their frusto-conical chambers 173. In each chamber 173, the suspension is separated into two flows. The first, termed the overflow, contains the finer particles and exits through first axial outlet 181 into outlet chambers 139 while the second, termed the underflow, containing coarser particles, exits through the opposite outlet 183 into chambers 141. The combined underflows from hydrocyclones 149 exit from assembly 111 through outlet duct 145, which protrudes from a side of the assembly 111, while the combined overflows exit through outlet ducts 147. Assembly 111 may be used for counter-current washing in corn wet milling, for thickening duties, or for other applications, where small particle sizes are involved.

In the manufacture of hydrocyclone 148 or 149 parts, a suitable material is selected based on a number of criteria, depending on the application. Relevant criteria include abrasion resistance, temperature resistance, pressure resistance, resistance to chemical attack, resistance to water absorption, among possibly others, such as difficulty of processing and expense. A number of materials may satisfy these categories, for example, teflon. If hydrocyclones 148 and 149 of the present invention are to be used for corn wet milling operations, polypropylene, which is not embrittled by sulfur dioxide in the same way as NYLON, and which has been approved by the FDA for these applications, is preferred. Polypropylene is amenable to molding with thinner walls, such that for a given external diameter of hydrocyclone 148 or 149, a larger internal diameter can be achieved, relative to the hydrocyclones of the prior art. For example, the 12 mm internal diameter hydrocyclone 148 or 149 may be made from polypropylene with substantially the same external dimensions as either of the prior-art 10 mm hydrocyclones because it is possible to mold the polypropylene with thinner walls. A larger internal diameter allows for greater hydraulic capacity, as one skilled in the art will readily appreciate.

A specific example of the preferred use of hydrocyclones 148 and 149 is in the separation of corn starch from gluten, as indicated above. For this purpose, a 12 mm-internal-diameter hydrocyclone 148 or washing cyclone 149 may be used instead of the prior art clamshell type hydrocyclone or type TM cyclone, respectively, having a maximum internal diameter of 10 mm. Rectangular inlet opening 176 or 177, respectively, provides for improved flow characteristics. Each of these features individually and in combination allows for an increase in throughput. The qualitative separation achieved by hydrocyclone 148 of the present invention, although not quite as good as that achieved by the smaller hydrocyclones 48, is still excellent and certainly acceptable, bearing in mind the savings achieved by the increased throughput and the longer working life of hydrocyclones 148. The savings in fact result from reductions in production times, lower power consumption, a reduction in the consumption of washing water for the corn starch, and stability of performance and capacity over the working life of the hydrocyclone.

An additional feature of the present invention is that cyclones 148 and 149 are fully interchangeable with prior art clamshell and TM type cyclones, respectively, capable of being installed side-by-side, so that there is no immediate need to discard existing cyclones 48 or 49 which are still in working order. However, when prior art clamshell type hydrocyclones and hydrocyclones 148 of the present invention are mixed in the same housing, it is advantageous to install hydrocyclones 148 together in one group, in order to take advantage of the interlocking hexagonal flanges 168 with a plurality of hydrocyclones 148 adjacent each other.

The illustrated best mode embodiments of the hydrocyclones of the present invention are directed to corn wet milling operations. However, the invention has broader application than the illustrated examples. It is understood that the foregoing detailed description is given merely by way of illustration and that modifications and variations may be made therein without departing from the spirit and scope of the invention.

What is claimed is:

1. A hydrocyclone comprising:

a tubular body having an underflow end, an opposite overflow end, an axially extending outer surface, and a retaining member said outer surface comprising a cylindrical portion, connecting to a frusto-conical portion which tapers toward said underflow end, and terminates in a frusto-conical spigot, wherein said spigot is partially surrounded circumferentially by a cylindrical skirt which terminates in a radially projecting stop member, wherein said stop member is hexagonal, and wherein said retaining member threadably mates with said tubular body at at least one of said underflow end or of said overflow end, said retaining member terminating in an outwardly projecting cap flange wherein said retaining member allows said tubular body a small amount of axial movement when the tubular body is fitted in opposing apertures of respective opposing wall members.

2. A hydrocyclone comprising:

a tubular body having an underflow end and an opposite overflow end, said body having a substantially cylindrical portion on said overflow end, connected by means of an annular radially projecting flange to a cylindrical boss of a smaller diameter, which, in turn, connects to a frusto-conical spigot which tapers from said cylindrical boss to said underflow end, wherein the length of said cylindrical portion spans substantially the entire distance between said overflow end of said cyclone and said flange thereof.

3. The cyclone of claim 2, wherein said cylindrical portion has a substantially rectangular opening formed therein.

4. The cyclone of claim 2 comprised of polypropylene.

5. The cyclone of claim 2, further comprising a vortex-finder member, said member having a guide surface, said guide surface being provided with a helical ramp to guide an inlet flow into said cyclone circumferentially and axially toward said underflow end.

6. A separator assembly comprising:

a first wall member and a second wall member opposing the first wall member defining a central inlet chamber between them, said wall members each having an outer face and an inner face, said wall members each having an outlet chamber on said outer face thereof, each of said wall members having at least one aperture opposing an aperture in the other wall member, each of the apertures of a pair of the opposing apertures communicating with said respective outer chamber; and a plurality of hydrocyclones fitted and sealed in respective pairs of the opposing apertures, wherein each of said hydrocyclones comprises:

a tubular body having an underflow end, an opposite overflow end and an axially-extending-conical separating chamber which tapers from said overflow end to said underflow end;

said body having a cooperating seat therein;

said frusto-conical separating chamber having an inlet chamber nearer said overflow end, a rectangular tangential inlet to said inlet chamber, and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber;

a retaining member which threadably mates with said tubular body at at least one of said underflow end of or of said overflow end, said retaining member terminating in an outwardly projecting cap flange wherein said retaining member allows said tubular body a small amount of axial movement when the tubular body is fitted in said opposing apertures of said opposing wall members;

wherein said underflow outlet is held coaxially with said overflow outlet and said inlet chamber by means of support gussets formed integrally with said body on said underflow end thereof.

7. A separator assembly comprising a first wall member and a second wall member opposing the first wall member defining a central inlet chamber between them, each of said wall members having at least one aperture opposing an aperture in the other wall member and each of the wall members having an outer face and an inner face opposing the inner face of the other wall member, said assembly further comprising at least one hydrocyclone comprising a tubular body having an overflow end and an opposite underflow end, a substantially cylindrical portion at said overflow end which connects to a substantially frusto-conical portion which tapers toward said underflow end, and a radially projecting stop member located toward said underflow end, external screw threading provided at said overflow end, a tubular vortex-finder member, and a retaining member provided with internal screw threading at an end face thereof.

8. A method of assembling a separator assembly comprising:

providing the separator assembly, wherein the separator assembly comprises:

a first wall member and a second wall member opposing the first wall member defining a central inlet chamber between them, each of said wall members having at least one aperture opposing an aperture in the other wall member and each of the wall members having an outer face and an inner face opposing the inner face of the other wall member, at least one hydrocyclone comprising a tubular body having an overflow end and an opposite underflow end, a substantially cylindrical portion at said overflow end which connects to a substantially frusto-conical portion which tapers toward said underflow end, a radially projecting stop member located toward said underflow end, external screw threading provided at said overflow end, a tubular vortex-finder member and a retaining member provided with internal screw threading at an end face thereof, wherein said tubular body of said hydrocyclone is sufficiently long to extend through said two opposing wall members, and wherein said tubular body has a smaller diameter than said apertures; and inserting said body through a pair of said opposing apertures of said wall members from said outer face of said second opposing member until said stop member abuts said outer face of said second opposing wall member, such that said overflow end projects from said outer face of said first opposing wall member to expose said external screw threading for engagement with said retaining member, and said underflow end projects from said outer face of said second opposing wall member past said stop member.

9. The method of claim 8, wherein said retaining member is screwed onto said body by means of cooperation of said internal screw threading at said end face of said retaining member with said external screw threading on said body.

10. The method of claim 9, wherein said body is free to slide axially in said apertures to a small extent.

11. A hydrocyclone comprising:

a tubular body having an underflow end and an opposite overflow end, said body having an exterior comprising an annular flange connecting to a cylindrical portion of a smaller diameter, connected by means of annular radially projecting flange to a cylindrical boss of a smaller diameter, and further connecting to a frusto-conical spigot which tapers form said boss toward said underflow end, said flange having an interior wall surface forming a cylindrical bore in said flange, said interior wall provided with a groove therein, and a vortex finder member comprising a cylindrical main body connected to a helical guide surface of a smaller diameter, said body molded with a peg and D-ring for snapping said peg into said groove when said vortex finder member is inserted into said tubular body of said cyclone, such that said main body of said vortex finder is seated in said cylindrical bore.

12. A hydrocyclone comprising:

a tubular body having an underflow end, an opposite overflow end and an axially-extending frusto-conical separating chamber which tapers from said overflow end to said underflow end;

said body having a cooperating seat therein;

said frusto-conical separating chamber having an inlet chamber nearer said overflow end, a tangential inlet to said inlet chamber and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber; and a retaining member which threadably mates with said tubular body at at least one of said underflow end or of said overflow end, said retaining member terminating in an outwardly projecting cap flange wherein said retaining member allows said tubular body a small amount of axial movement when the tubular body is fitted in opposing apertures of respective opposing wall members.

13. The hydrocyclone of claim 12, wherein said retaining member is a hexagonal nut.

14. The hydrocyclone of claim 12, wherein said retaining member is a blank retaining member.

15. The hydrocyclone of claim 14, wherein the tubular body is a blank body.

16. A separator assembly comprising:

a first wall member and a second wall member opposing the first wall member defining a central inlet chamber between them, said wall members each having an outer face and an inner face, said wall members each having an outlet chamber on said outer face thereof, each of said wall members having at least one aperture opposing an aperture in the other wall member, each of the apertures of a pair of the opposing apertures communicating with the respective outlet chamber; and a plurality of hydrocyclones, each of said hydrocyclones comprising:

a tubular body having an underflow end, an opposite overflow end and an axially-extending frusto-conical separating chamber which tapers from said overflow end to said underflow end;

said body having a cooperating seat therein;

said frusto-conical separating chamber having an inlet chamber nearer said overflow end, a tangential inlet to said inlet chamber, and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber; and a retaining member which threadably mates with said tubular body and terminates in an outwardly projecting flange;

wherein the hydrocyclones are fitted and sealed in respective pairs of the opposing apertures and each of the hydrocyclones has the retaining member mated to the tubular body, said flange of said retaining member being spaced from said outer face of said first wall member such that said hydrocyclone is free to slide axially in said apertures.

17. A separator assembly comprising:

a first wall member and a second wall member opposing the first wall member defining a central inlet chamber between them, said wall members each having an outer face and an inner face, said wall members each having an outlet chamber on said outer face thereof, each of said wall members having at least one aperture opposing an aperture in the outer wall member and each of the apertures of a pair of the opposing apertures communicating with said respective outlet chamber; and a hydrocyclone comprising a tubular body having an underflow end, an opposite overflow end and an axially extending outer surface, wherein said outer surface comprises a cylindrical portion connection to a frusto-conical portion which tapers toward said underflow end and terminates in a frusto-conical spigot, wherein said spigot is partially surrounded circumferentially by a cylindrical skirt which terminates in a radially projecting stop member, wherein said stop member is hexagonal.

18. The separator assembly of claim 17, wherein, when the tubular bodies of a respective plurality of said hydrocyclones are fitted through respective pairs of the opposing apertures during assembly of said separator assembly, said hexagonal stop members are sufficiently close to each other such that said stop members cooperate with each other, in an interlocking arrangement, to prevent said hydrocyclones from rotating about their respective axes.

19. A separator assembly comprising:

a first wall member and a second wall member opposing the first wall member defining a central inlet chamber between them, said wall members each having an outer face and an inner face, said wall members each having an outlet chamber on said outer face thereof, each of said wall members having at least one aperture opposing an aperture in the other wall member and each of the apertures of a pair of the opposing apertures communicating with said respective outlet chamber; and a cyclone comprising:

a tubular body having an underflow end, an opposite overflow end, and an axially-extending frusto-conical separating chamber which tapers from said overflow end to said underflow end;

said body having a cooperating seat therein;

said frusto-conical separating chamber having an inlet chamber nearer said overflow end, a tangential inlet to said inlet chamber, and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber; and a retaining member which threadably mates with said tubular body at at least one of said underflow end and said overflow end, said retaining member terminating in an outwardly projecting cap flange, wherein the retaining member is a blank retaining member.

20. A separator assembly comprising:

a first wall member and a second wall member opposing the first wall member defining a central inlet chamber between them, said wall members each having an outer face and an inner face, said wall members each having an outlet chamber on said outer face thereof, each of said wall members having at least one aperture opposing an aperture in the other wall member and each of the apertures of a pair of the opposing apertures communicating with said respective outlet chamber; and a cyclone comprising a tubular body having an underflow end and an opposite overflow end, said tubular body having a substantially cylindrical portion on said overflow end, connected by means of annular radially projecting flange to a cylindrical boss of a smaller diameter, which, in turn, connects to a frusto-conical spigot which tapers from said cylindrical boss to said underflow end, wherein said cylindrical portion is relatively long, spanning substantially the entire distance between said overflow end of said one hydrocyclone and said flange thereof.

21. A process of purifying corn starch comprising:

providing a separator assembly comprising:

a first opposing wall member and a second wall member opposing the first wall member defining a central inlet chamber between them, said wall members each having an outer face and an inner face, said wall members each having an outlet chamber on said outer face thereof, each of said wall members having at least one aperture opposing an aperture in the other wall member and opposing each of the apertures of a pair of the opposing apertures communicating with said respective outlet chamber; and a plurality of hydrocyclones, each of said hydrocyclones comprising:

tubular body having a cooperating seat therein;

said frusto-conical separating chamber having an inlet chamber nearer said overflow end, a tangential inlet to said inlet chamber, and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber;

a retaining member which threadably mates with said tubular body and terminates in an outwardly projecting flange;

wherein the hydrocyclones are fitted and sealed in respective pairs of the opposing apertures and each of the hydrocyclones has the retaining member mated to the tubular body, said flange of said retaining member being spaced from said outer face of said first opposing wall member such that said hydrocyclones is free to slide axially in said apertures;

pumping a suspension to be classified into the central inlet chamber of said separator assembly under pressure such that said suspension is forced from said central inlet chamber through said tangential inlet of at least one of said hydrocyclones into said frusto-conical separating chamber thereof to provide for separating of said suspension into an overflow which exits through said overflow end and an underflow which exits through said underflow outlet opening.

22. A process of purifying corn starch comprising:

providing a separator assembly comprising:

a first wall member and a second wall member opposing the first wall member defining a central inlet chamber between them, said wall members each having an outer face and an inner face, said wall members each having an outlet chamber on said outer face thereof, each of said wall members having an aperture opposing an aperture in the other wall member and each of the apertures of a pair of the opposing apertures communicating with said respective outlet chamber; and housing a plurality of hydrocyclones in respective pairs of the opposing apertures in the separator assembly, each of said hydrocyclones comprising:

a tubular body having an underflow end, an opposite overflow end, and an axialy-extending frusto-conical separating chamber which tapers from said overflow end to said underflow end;

said body having a cooperating seat therein;

said frusto-conical separating chamber having an inlet chamber nearer said overflow end, a tangential inlet to said inlet chamber, and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber; and a retaining member which threadably mates with said tubular body at at least one of said underflow end and said overflow end, said retaining member terminating in an outwardly projecting cap flange;

wherein the retaining member of at least one of the hydrocyclones is a blind retaining member; and forcing a suspension to be classified through said tangential inlet of at least one said hydrocyclones and into said frusto-conical separating chamber thereof to provide for separating of said suspension into an overflow which exists through said overflow end and an underflow which exists through said underflow outlet opening.

23. A method of disassembling a separator assembly comprising:

providing the separator assembly, wherein the assembly comprises:

a first wall member and a second wall member opposing the first wall member defining a central inlet chamber between them, each of said wall members having at least one aperture opposing and coaxial with an aperture in the other wall member and each of the wall members having an outer face and an inner face opposing the inner face of the other wall member, at least one hydrocyclone comprising:

a tubular body having an overflow end and an opposite underflow end, a substantially cylindrical portion at said overflow end which connects to a substantially frusto-conical portion which tapers toward said underflow end, and a radially projecting stop member located toward said underflow end, external screw threading provided at said overflow end, a tubular vortex-finder member, and a retaining member provided with internal screw threading at an end face thereof, wherein said tubular body of said hydrocyclone is sufficiently long to extend through said two opposing wall members, and wherein said tubular body has a smaller diameter than said apertures;

wherein said body of the hydrocyclone has been inserted through a pair of the opposing apertures of said wall members, from said outer face of said second opposing member until said stop member abuts said outer face of said second opposing wall member, such that said overflow end projects from said outer face of said first opposing wall member to expose said external screw threading for engagement with said retaining member, and said underflow end projects from said outer face of said second opposing wall member past said stop member;

disengaging said retaining member from said external screw threading; and removing said retaining member and withdrawing said hydrocyclone from said coaxial apertures.

24. A hydrocyclone comprising:

a tubular body having an underflow end, an opposite overflow end and an axially-extending frusto-conical separating chamber which tapers from said overflow end to said underflow end;

said body having a cooperating seat therein;

said frusto-conical separating chamber having an inlet chamber nearer said overflow end, a rectangular tangential inlet to said inlet chamber and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber;

wherein said body includes a means for supporting said underflow outlet thereby ensuring that said underflow outlet is aligned with said overflow outlet and coaxial with said inlet chamber; and a retaining member which threadably mates with said tubular body at at least one of said underflow end or said overflow end, said retaining member terminating in an outwardly projecting cap flange wherein said retaining member allows said tubular body a small amount of axial movement when the tubular body is fitted in opposing apertures of respective opposing wall members.

25. A hydrocyclone comprising:

a tubular body having an underflow end, an opposite overflow end and an axially-extending frusto-conical separating chamber which tapers from said overflow end to said underflow end;

said body having a cooperating seat therein;

said frusto-conical separating chamber having an inlet chamber nearer said overflow end, a rectangular tangential inlet to said inlet chamber and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber, wherein the vortex-finder member includes a blank insert; and a retaining member which threadably mates with said tubular body at at least one of said underflow end or of said overflow end, said retaining member terminating in an outwardly projecting cap flange wherein said retaining member allows said tubular body a small amount of axial movement when the tubular body is fitted in opposing apertures of respective opposing wall members.

26. A hydrocyclone comprising:

a tubular body having an underflow end, an opposite overflow end and an axially-extending frusto-conical separating chamber which tapers from said overflow end to said underflow end;

said body having a cooperating seat therein;

said frusto-conical separating chamber having an inlet chamber nearer said overflow end, a rectangular tangential inlet to said inlet chamber and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber;

wherein said body is formed with a means for supporting said underflow outlet opening, thereby ensuring that said underflow outlet is aligned with said overflow outlet and coaxial with said inlet chamber, wherein the means for supporting said underflow outlet comprises support gussets.

27. A process of purifying corn starch comprising:

providing a hydrocyclone comprising:

a tubular body having an underflow end, an opposite overflow end, and an axially-extending frusto-conical separating chamber which tapers from said overflow end to said underflow end;

said body having a cooperating seat therein;

said frusto-conical separating chamber having an inlet chamber nearer said overflow end, a tangential inlet to said inlet chamber, and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber;

a retaining member which threadably mates with said tubular body at at least one of said underflow end and said overflow end, said retaining member terminating in an outwardly projecting flange; and forcing a suspension to be classified through said tangential inlet of said hydrocyclone into said frusto-conical separating chamber thereof to provide for separating of said suspension into an overflow which exits through said overflow end and an underflow which exists through said underflow outlet opening.

28. A separator assembly comprising:

a first wall member and a second wall member opposing the first wall member defining a central inlet chamber between them, said wall members each having an outer face and an inner face, said wall members each having an outlet chamber on said outer face thereof, each of said wall members having at least one aperture opposing an aperture in the other wall member and each of the apertures of a pair of the opposing apertures communicating with said respective outlet chamber; and a plurality of hydrocyclones, each of said hydrocyclones comprising:

a tubular body having an underflow end, an opposite overflow end and an axially-extending frusto-conical separating chamber which tapers from said overflow end to said underflow end;

said body having a cooperating seat therein;

said frusto-conical separating chamber having an inlet chamber nearer said overflow end, a tangential inlet to said inlet chamber, and an underflow outlet opening at each underflow end;

a tubular vortex-finder member insertable through said overflow end of said body into said cooperating seat, said member seated in a predetermined position in which a portion thereof extends through said inlet chamber to define an axial overflow outlet from said separating chamber, wherein said portion of the member comprises a helical surface means for guiding an inlet flow circumferentially and axially from said tangential inlet toward said separating chamber;

a retaining member which threadably mates with said tubular body at at least one of said underflow end or of said overflow end, said retaining member terminating in an outwardly projecting cap flange wherein said retaining member allows said tubular body a small amount of axial movement when the tubular body is fitted in said opposing apertures of respective opposing wall members; and wherein the hydrocyclones are fitted and sealed in respective pairs of the opposing apertures.

29. The separator assembly of claim 28, wherein said hydrocyclones are comprised of polypropylene.

30. The separator assembly of claim 28, wherein said hydrocyclones are manufactured by injection molding.

31. The separator assembly of claim 28, wherein said tangential inlet is rectangular.

32. The separator assembly of claim 28, wherein said body of said hydrocyclone is formed with means for supporting said underflow outlet, thereby ensuring that said underflow outlet is aligned with said overflow outlet and coaxial with the opposing apertures in the respective first and second walls defining said central inlet chamber.

33. A process of purifying corn starch comprising:

providing a hydrocyclone comprising:

a tubular body having an underflow end, an opposite overflow end, and an axially-extending frusto-conical separating chamber which tapers from said overflow end to said underflow end;

said body having a cooperating seat therein;

said frusto-conical separating chamber having an inlet chamber nearer said overflow end, a tangential inlet to said inlet chamber, and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber, wherein said portion of the member includes a helical surface means for guiding said inlet flow circumferentially and axially from said tangential inlet toward said separating chamber;

a retaining member which threadably mates with said tubular body at at least one of said underflow end or of said overflow end, said retaining member terminating in an outwardly projecting cap flange wherein said retaining member allows said tubular body a small amount of axial movement when the tubular body is fitted in opposing apertures of respective opposing wall members; and forcing a suspension to be classified through said tangential inlet of said hydrocyclone into said frusto-conical separating chamber thereof to provide for separating of said suspension into an overflow which exits through that overflow end and an underflow which exits through said underflow outlet opening.

34. The process of claim 33, wherein said hydrocyclone is manufactured by injection molding.

35. A process of purifying corn starch comprising:

providing a separator assembly comprising:

a first opposing wall member and a second wall member opposing the first wall member defining a central inlet chamber between them, said wall members each having an outer face and an inner face, said wall members each having an outlet chamber on said outer face thereof, each of said wall members having at least one aperture opposing an aperture in the other wall member, each of the apertures of a pair of the opposing apertures communicating with said respective outlet chamber; and a plurality of hydrocyclones, each of which hydrocyclones comprising:

a tubular body having an underflow end, an opposite overflow end, and an axially-extending frusto-conical separating chamber which tapers from said overflow end to said underflow end;

said body having a cooperating seat therein;

said frusto-conical separating chamber having an inlet chamber nearer said overflow end, a tangential inlet to said inlet chamber, and an underflow outlet opening at said underflow end;

a tubular vortex-finder member insertable through said overflow end of said body into said cooperating seat, said member seated in a predetermined position in which a portion thereof extends through said inlet chamber to define an axial overflow outlet from said separating chamber, wherein said portion of the member includes a helical surface means for guiding said inlet flow circumferentially and axially from said tangential inlet toward said separating chamber;

a retaining member which threadably mates with said tubular body at at least one of said underflow end or of said overflow end, said retaining member terminating in an outwardly projecting cap flange wherein said retaining member allows said tubular body a small amount of axial movement when the tubular body is fitted in said opposing apertures of said opposing wall members; and wherein at least one of the hydrocyclones is fitted and sealed in a respective one of the at least one pair of the opposing apertures; and pumping a suspension to be classified into said central inlet chamber of said separator assembly under pressure, such that said suspension is forced from said central inlet chamber through said tangential inlet of said hydrocyclone into said frusto-conical separating chamber thereof, such that said suspension is separated into an overflow which exits through said overflow end and an underflow which exits through said underflow outlet opening.

36. The process of claim 35, wherein said hydrocyclones are manufactured by injection molding.

* * * * *